US006942760B1

(12) United States Patent
Heikkilä et al.

(10) Patent No.: US 6,942,760 B1
(45) Date of Patent: Sep. 13, 2005

(54) ARRANGEMENT IN THE WET END OF A PAPER MACHINE

(75) Inventors: Pertti Heikkilä, Laukaa (FI); Antti Poikolainen, Jyväskylä (FI); Ari Puurtinen, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 400 days.

(21) Appl. No.: 10/111,342

(22) PCT Filed: Oct. 26, 2000

(86) PCT No.: PCT/FI00/00925

§ 371 (c)(1),
(2), (4) Date: Jul. 24, 2002

(87) PCT Pub. No.: WO01/31120

PCT Pub. Date: May 3, 2001

(30) Foreign Application Priority Data

Oct. 29, 1999 (FI) ..... 19992337

(51) Int. Cl.[7] ..... D21F 2/00
(52) U.S. Cl. ..... 162/306; 162/301; 162/300; 162/363; 162/264; 162/203
(58) Field of Search ..... 162/306, 301, 162/300, 363, 203, 264

(56) References Cited

U.S. PATENT DOCUMENTS

| | | | | |
|---|---|---|---|---|
| 3,941,651 | A * | 3/1976 | Koski | 162/301 |
| 4,081,320 | A | 3/1978 | Wahren et al. | |
| 4,116,763 | A | 9/1978 | Stotz et al. | |
| 5,736,011 | A | 4/1998 | Kade et al. | |
| 6,322,668 | B1 | 11/2001 | Snellman et al. | |

FOREIGN PATENT DOCUMENTS

| | | |
|---|---|---|
| DE | 2550071 | 6/1976 |
| FI | 965277 | 12/1996 |
| WO | WO 98/29600 | 7/1998 |
| WO | WO 01/31120 | 5/2001 |

* cited by examiner

*Primary Examiner*—Mark Halpern
(74) *Attorney, Agent, or Firm*—Stiennon & Stiennon

(57) ABSTRACT

At the end of the twin wire zone of a paper machine former, a suction box (17) inside the upper wire loop (11) has a curved lid (17') opposite a roll (18) within the lower wire loop (10). The lid is curved in a run situation so the tension of the upper wire (11) reduces the normal force between the wire (11) and the lid (17') caused by the underpressure of the suction box. The underpressure keeps the web mainly off from the roll (18) and the lower wire (10) while being adhered to the underside of the upper wire (11) and conforming to the curved shape of the lids. Members **(17*a*, 18') are provided for making the web follow the lower wire (10)** in a break situation for conducting it to the broke handling system.

25 Claims, 3 Drawing Sheets

ARRANGEMENT IN THE WET END OF A PAPER MACHINE

CROSS REFERENCES TO RELATED APPLICATIONS

This application is a U.S. national stage application of International Application No. PCT/FI00/00925, filed Oct. 26, 2000, and claims priority on Finnish Application No. 19992337 filed Oct. 29, 1999, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to an arrangement in the wet end of a paper machine for transferring a web from the former to the press section, said former comprising a twin wire zone mutually defined by an upper wire loop and a lower wire loop, whereafter the web is arranged to follow the upper wire to a transfer point where the web is transferred from the underside of the upper wire onto the top side of the weave included in the press section.

The transfer of a web formed in the wire section of the paper machine to the press section is an important phase which greatly affects the reliability of the paper machine running. A reliable transfer of a wet and weak web from the former to the press section requires a good grip of the web onto the surface of the pick-up felt or the surface of the transfer belt. This important process phase usually includes also web edge trimming and running of the web into the pulper in break situations.

In a number of twin wire formers known in the art the web is at the end of the twin wire zone released from the upper wire and made to follow the lower wire, from the downwards slanting run whereof it is picked in a transfer point with the aid of a pick-up roll onto the underside of a pick-up felt, said felt acting also as a water receiving press weave in the first press nip. Alternatively, a web supported by the lower wire can be conducted, together with the transfer belt, into a pre-press nip, in which it is made to engage with adhesion onto the underside of the water non-receiving transfer belt with smooth surface. At the end of the twin wire zone, in the proximity of the release point a suction roll and/or suction boxes is/are in general placed inside the lower wire loop, the function of which is, not only to increase the dry matter content of the web, but also to secure that the web follows the lower wire after the release point. When modern suction rolls and suction boxes acting on high underpressure are used to intensify water removal, problems may arise, especially at high speeds of running, in the transfer point where the web is intended to be released from the lower wire and made to grip reliably onto the underside of the transfer weave.

In order to solve problems related to web transfer, arrangements are disclosed in U.S. Pat. Nos. 4,116,763 and 5,736,011, in which the web is after the twin wire zone arranged to follow the upper wire, from the underside of which it is transferred in the transfer point onto the top side of the transfer weave. At the end of the twin wire zone, the web is separated from the lower wire with the aid of a suction roll or a suction box arranged inside the upper wire loop. In said designs the problem still is how to achieve sufficient grip of the web onto the upper wire with the aid of conventional suction rolls and suction boxes, because of which the space from the end of the twin wire zone to the pick-up point has to be kept short and/or the web has to be supported by means of a suction box or suction roll positioned on the side of the upper wire. When the space is short, the trimming of the web, the removal of the trimmed strips and the running of the web into the couch pit are difficult to arrange.

SUMMARY OF THE INVENTION

The objective of the present invention is to solve the problems related to the state of the art and to achieve a novel structure of the wet end of the paper machine, which improves the runnability of the machine and facilitates the transfer of the web from the former to the press section.

To achieve the above aim and those to be disclosed below, the invention is characterized in that at the end of the twin wire zone a suction box is provided inside the upper wire loop and an open roll inside the lower wire loop facing it, the lid of said suction box being curved at least in a running situation so that the tightness of the upper wire reduces the normal force between the wire and the lid caused by the underpressure of the suction box, and in which suction box, underpressure can be arranged which keeps the web at the suction box mainly off the roll and off the lower wire when the upper wire is adhered to the underside to the upper wire and following the curved shape of the lid of the suction box, and that members are arranged in connection with the suction box and/or the roll to make the web follow the lower wire in a break situation for conducting it into the broke handling system.

In the design of the invention, the suction roll of the wire section can be omitted and substituted with an open-surface tubular roll. Water removal is carried out by means of a low-friction suction box with a curved surface and operating at high underpressure through the upper wire. For the suction box, for instance, a suction box described in the FI patent application No. 965277 of Metso Paper, Inc. can be used, in which the lid of the underpressure chamber or lathing in an equivalent position forms, at least in a running situation, a curved support surface for the wire. In a suction box like this the friction between the wire and the lathing or between the wire and the lid is very small. The open surface of the roll is needed in starting situations to make the web grip onto the surface of the upper wire conforming to the lathing lid of the suction box. In addition, the roll supports the edges of the web, to the area of which the underpressure effect of the suction box will not extend. In a normal running situation the web follows the upper wire, on the surface of which it grips by the effect of the suction box. When wishing to run the web into the couch pit while being started up or in another break situation, it can be made to follow the lower wire e.g. by arranging blowing on the side of the upper wire or the suction on the side of the lower wire or by dimensioning the open surface area of the roll appropriately.

After engaging the web subsequent to the twin wire zone reliably onto the underside of the upper wire, the trimming can be performed from below the web, and the releasing of the trimmed strips from the web is easy. The trimmed strips can be released for instance by directing air blow to the area of the trimmed strips of the web through the upper wire or making the strips adhere on the surface of rolls corresponding in width thereto, from where they can be doctored off.

With the design of the invention, savings in costs can be achieved when the suction roll of the wire section can be replaced by an open-surface tubular roll. Supported by the suction box, water is discharged on the roll in natural direction, that is, outwards from the roll. The number of dragging elements can be reduced in the inner wire looping critical to the wear of the wire. In a break situation, guiding the web into the couch pit is carried out before the pick-up point, which is important especially when a suction box operating on high underpressure in connection with the pick-up roll is used. Removal of the trimmed strip from the wire immediately after the trimming facilitates the handling of the web in the transfer point. When all apparatus used for trimming are located below the web, problems related to fouling of couch squirts are reduced. Also monitoring of the web edges is facilitated when the web after the former is transferred instead of the underside of the transfer weave onto its top side.

Transferring the web to the pick-up point on the underside of the upper wire and removing the trimmed strips before the transfer point improve the runnability of the pick-up area and simplify its structure because the pick-up roll can be made fixed. These features on their part make the use of a low-friction suction box easier in the pick-up area or the use of a pre-press nip and a transfer belt in transferring the web.

BRIEF DESCRIPTION OF THE DRAWINGS

The invention is described below, reference being made to the figures of the accompanying drawings, to the details of which the invention is not, however, intended to be exclusively restricted.

DESCRIPTION OF THE PREFERRED EMBODIMENTS

Figure 1:
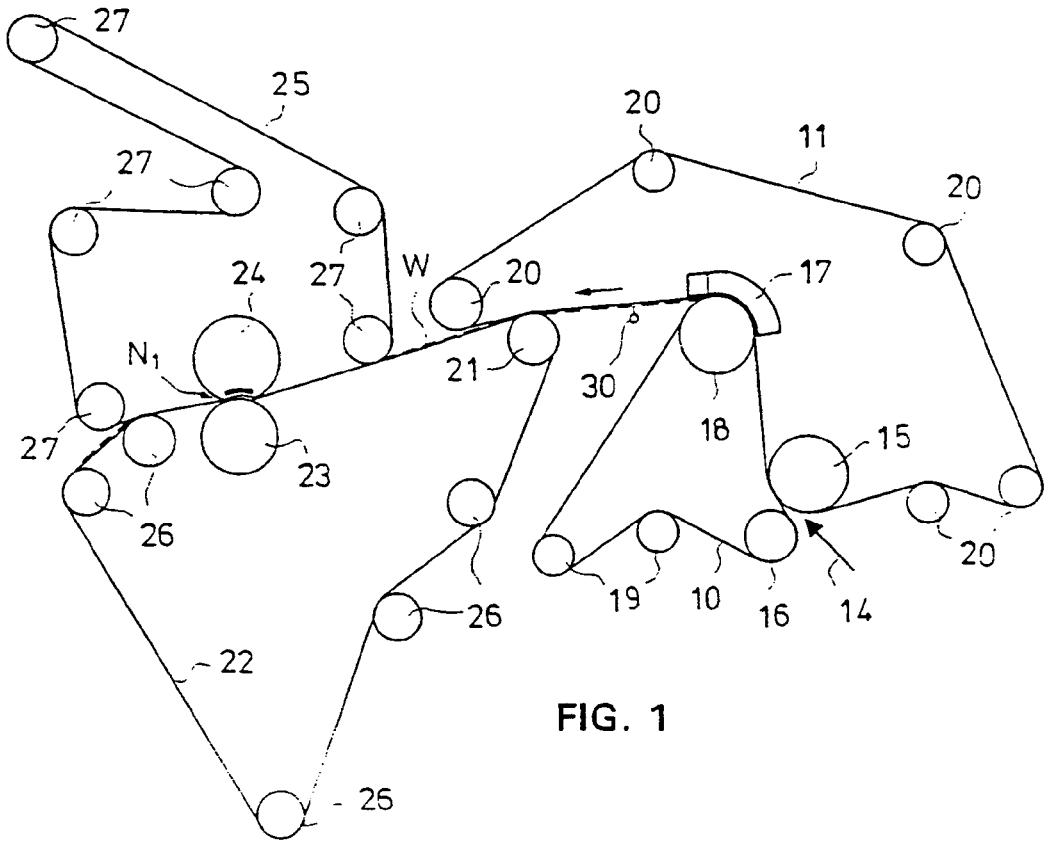
FIG. 1 presents schematically a former and a first press of the press section.

FIG. 1 presents schematically part of the wet end of a paper machine and especially the web former and a first press nip N of the press section. The web former comprises a lower wire loop 10 and an upper wire loop 11, defining therebetween a twin-wire web formation and water removal zone. Said twin wire zone starts with a forming gap, into which a pulp suspension jet 14 is fed from the headbox (not shown). The forming gap is defined by the lower wire 10 guided by a breast roll 16 and the upper wire 11 guided by a forming roll 15. In the area of the twin wire zone, a web passing between the wires 10, 11 is affected by a number of web formation and water removal elements known as such in the art, which are not illustrated more in detail in FIG. 1. The twin wire zone ends in a suction box 17 with a curved surface and placed inside the upper wire loop 11, facing which a roll 18 is placed inside the lower wire loop 10. The course of the lower wire loop 10 is controlled by the breast roll 16 and leading rolls 19 in addition to the roll 18. The course of the upper wire loop 11 is controlled by the forming roll 15 and a number of leading rolls 20.

The press section includes a press roll 23 and a shoe roll 24, defining therebetween a press nip $N_1$. Web W is directed into the nip $N_1$ supported by two press felts 22 and 25, receiving the water pressed from the web in the nip $N_1$. The lower press felt 22 also acts as a pick-up felt and its course is controlled by the pick-up roll 21 and a number of leading rolls 26. The course of the upper felt 25 is controlled by leading rolls 27.

At the end of the twin wire zone the web W is released from the lower wire 10 with the aid of the suction box 17 placed on the side of the upper wire 11 and it is made to follow the upper wire 11. The pick-up roll 21 and the pick-up felt 22 passing thereabove are arranged to touch the upper wire 11 in the transfer point and the web fastened to the underside thereof, whereby the web is transferred, due to the action of the underpressure prevailing in the suction zone of the roll 21, on the top surface of the pick-up felt 22, supported by which it is conducted into the press nip $N_1$.

A trimming means 30 is positioned at the end of the former to a point between the ending point of the twin wire zone and the pick-up point where the web W is adhered to the underside of the upper wire 11.

Figure 2:
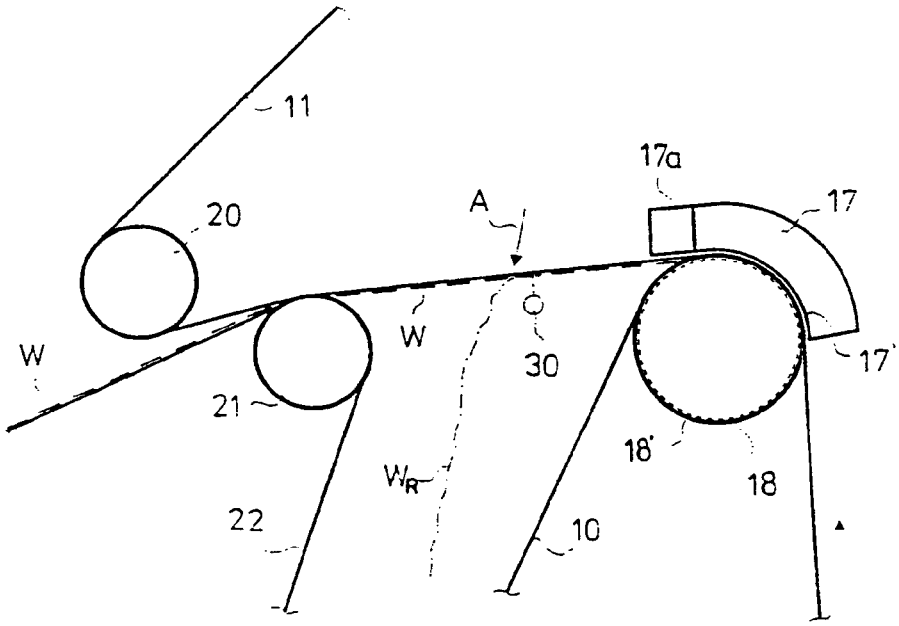
FIG. 2 presents a suction box-roll combination arranged at the end of the twin wire zone and the subsequent web transfer from the forming wire onto the pick-up fabric.

FIG. 2 presents enlarged the area of the wet end of the paper machine in which the web W is released from the lower wire 10 after the twin wire zone and is transferred, supported by the upper wire 11, to the pick-up point and further, owing to impact of the pick-up roll 21, to the pick-up felt 22. At the end of the twin wire zone, a suction box 17 with curved surface is positioned inside the upper wire loop 11, to which a second suction box 17*a* is advantageously connected, in which the surface facing the upper wire 11 is straight. Preferably, the suction box 17 is of the type described in FI patent application No. 965277, so that it includes a curved lath lid 17' or a number of consecutive laths set in curved position, at least in a running situation, so that the tension of the wire 11 reduces the normal force between the wire 11 and the lath lid 17' caused by the underpressure of the suction box 17. Facing the suction box 17, an open-surface tubular roll 18 is placed inside the lower wire loop 10, which can be, for instance, grooved, blind-bored or another roll with cored-out surface. Also a suction roll is conceivable. The open surface 18' of the roll 18 is needed in a starting situation to make web W be adhered to the surface of the suction box 17 and the upper wire 11 passing thereabove. In a running situation, the web W is at the suction box 17 off from the surface 18' of the roll and adhered to the upper wire 11, the passing of which conforms to the curved shape of the lath lid 17' of the suction box. Simultaneously, the edge areas of the roll 18 support the edges of the web W. Water removal on the roll 18 is carried out in the natural direction, off from the roll 18 through the upper wire 11 aided by the underpressure of the suction box 17. The underpressure used in the suction box 17 is preferably of the order of 60 to 80 kPa.

Figure 3:
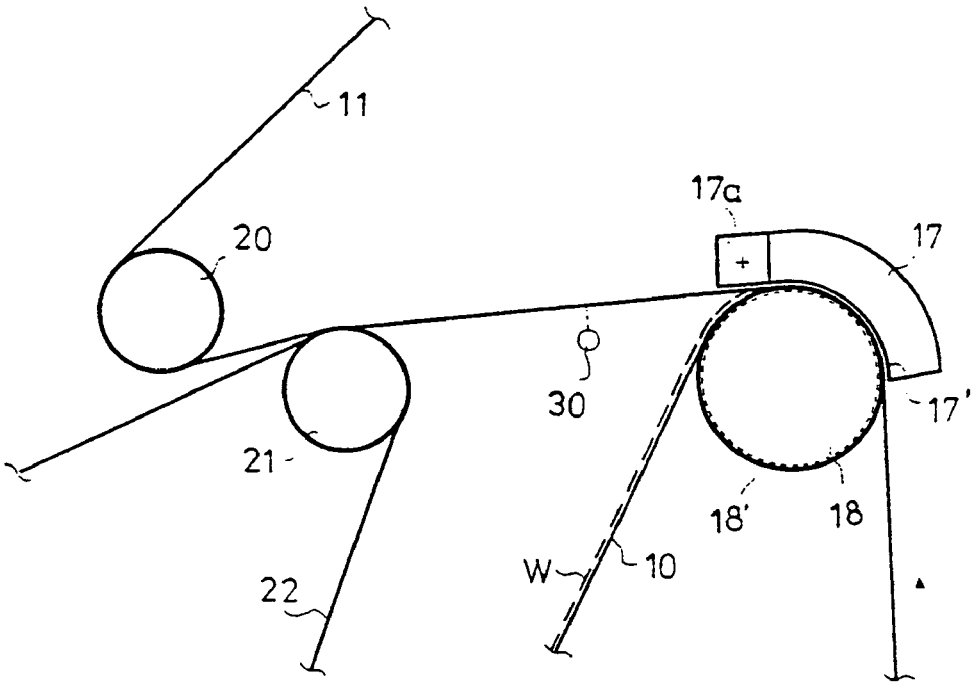
FIG. 3 presents the conducting of the web into the couch pit with the aid of air blow subsequent to the suction box.

Preferably, a separate suction/blow unit 17*a* is placed after the suction box 17, in which a different underpressure or even overpressure can be used, as shown in FIG. 3. Said second suction zone 17*a* is positioned in the straight run of the upper wire 11 beginning after the curved sector of the roll 18.

The edges of the web W are trimmed in a manner known in itself in the art after the twin wire zone prior to transferring the web W into the press section. On both edges of the web, a couch squirt 30 is arranged to trim the strips $W_R$ from the edges of the web W adhered onto the underside of the upper wire 11, which are immediately separated from the middle part of the web and conducted to the couch pit. Releasing trimmed strips $W_R$ from the upper wire 11 and falling down can be secured, for instance, by air flow blown through the upper wire 11, as demonstrated by an arrow A in FIG. 2. After separating the trimmed squirts $W_R$, the web is transferred from the underside of the upper wire 11 onto the top side of the pick-up felt 22 which it grips when influenced by the underpressure acting in the pick-up roll 21.

Figure 4:
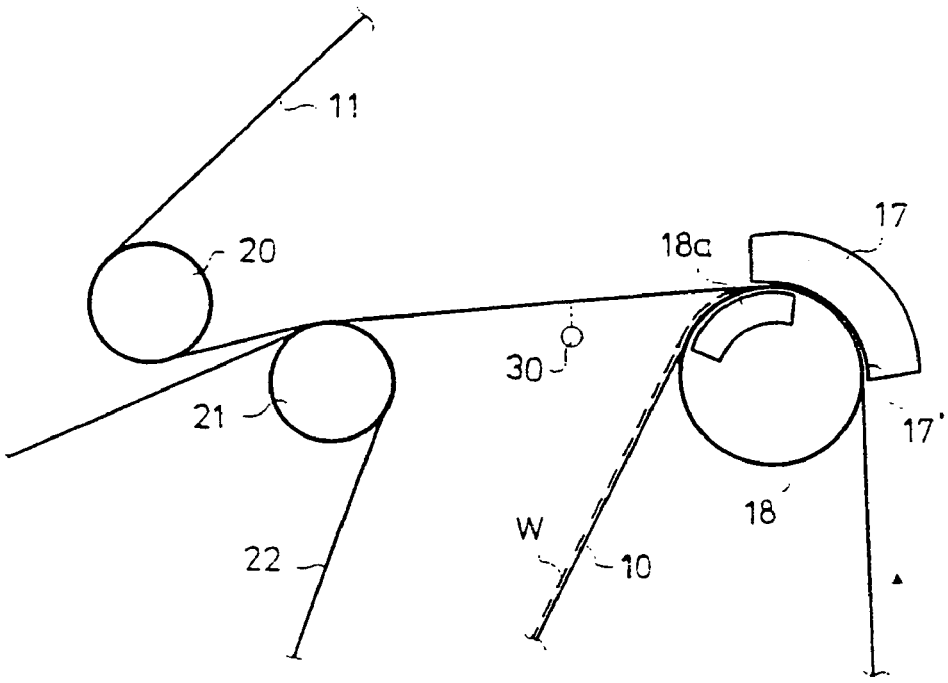
FIG. 4 presents the conducting of the web into the couch pit with the aid of an underpressure zone arranged within the roll.

As described above, the web W follows in a normal running situation the upper wire 11 after the twin wire zone, onto the surface of which it is adhered with the aid of a relatively high underpressure prevailing in the suction box 17. When the web W is desired to be run into the couch pit in a break situation or in connection with a start-up, it is directed to follow the lower wire 10 after the twin wire zone. This is arranged, for instance, by providing overpressure into a separate suction/blow zone 17*a* after the suction box 17, to blow the web W downwards off from the upper wire 11 and to follow the lower wire 10. Alternatively, the web W can be driven down by arranging an underpressure chamber 18*a* within the open roll 18 as shown in FIG. 4, in which underpressure is arranged in a break situation. Hereby, the body of the roll 18 must be provided with through-borings. A third alternative is to select the proportion of the open surface area of the roll body 18' so that when no certain underpressure is prevailing in the suction box 17, the web W automatically tends to follow the lower wire 10. In such instance, no special arrangements such as blowing 17*a* or suction 18*a* are needed for conducting the web into the couch pit.

When a standard suction roll acts as a backing roll 18 of the suction box 17, guiding the web to the press section or into the couch pit can be carried out using a release suction box 17*a* on the side of the upper wire 11 and/or a blow block 18*a* inside the suction roll. Advantageously, underpressure or overpressure can be used in both of said suction/blow blocks 17*a* and 18*a*, depending on the running situation.

Figure 5:
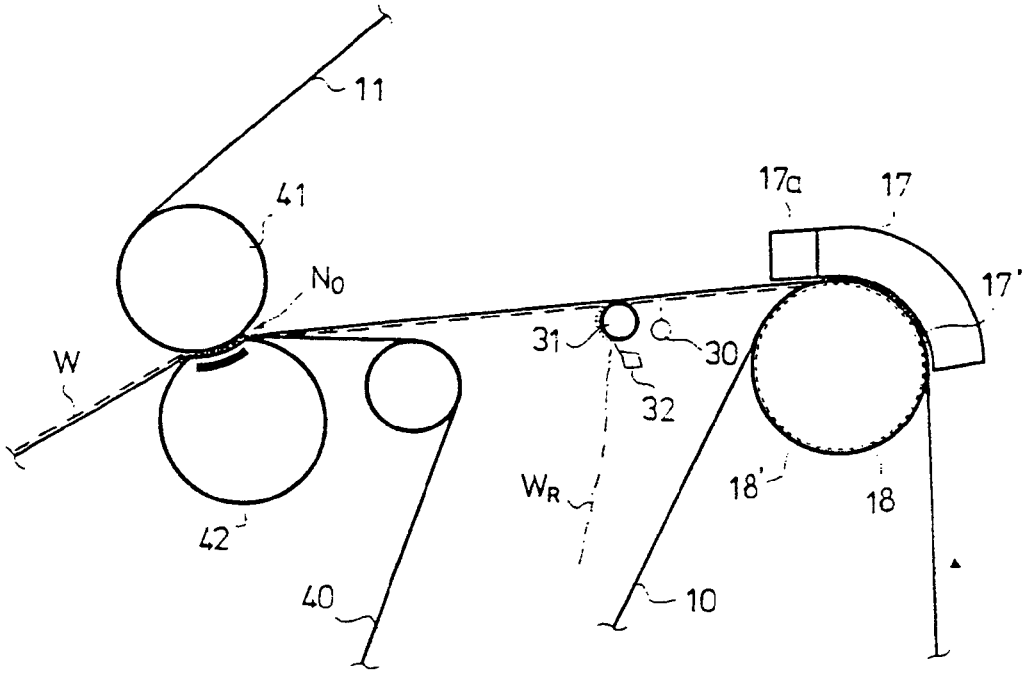
FIG. 5 shows an embodiment of the invention in which the web is, after the forming section, transferred in a pre-press nip from the underside of the upper wire onto the top side of the transfer belt.

FIG. 5 presents an alternative design for handling trimmed strips $W_R$, in which a trimmed strip $W_R$ is, after the couch squirt 30, made to adhere onto the surface of a smooth roll 31 equivalent in width to the strip $W_R$ and conducted into separation from the uniform area left in the middle of web W. From the surface of the roll 31, the trimmed strip $W_R$ is released with a doctor 32 and conducted into the couch pit.

In FIG. 5, the transfer arrangement of web W comprises a transfer belt 40, being adhered to the underside of the web W in a pre-press nip $N_0$ formed by a press roll 41 inside the upper wire loop 11 and a shoe roll 42 inside the transfer belt loop 40. In the pre-press nip $N_0$, the web W is attached, through the adhesion effect, onto the surface of the smooth and water non-receiving transfer belt 40. Right after the nip $N_0$ the web W is directed off from the upper wire 11, in order to avoid rewatering the web with the water absorbed in the upper wire 11.

Figure 6:
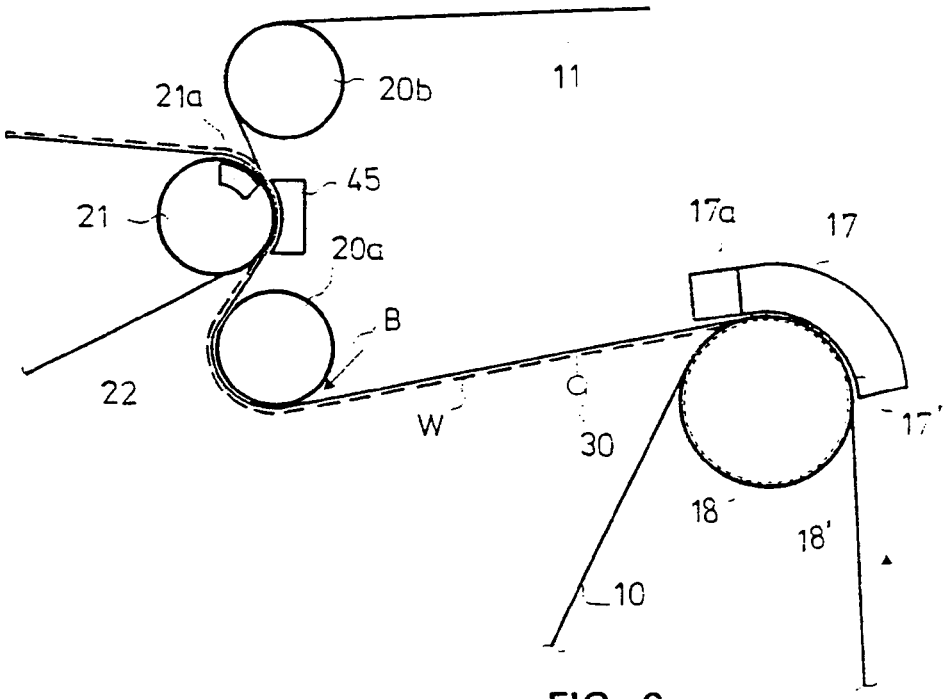
FIG. 6 presents an embodiment of the invention in which a suction box with curved surface is arranged to be in connection with the pick-up roll.

FIG. 6 presents a design in which, at the pick-up roll 21, a low-friction suction box 45 acting on high underpressure is positioned inside the upper wire loop 11, the lath lid whereof being curved against the roll 21. The web W adhered to the underside of the upper wire 11 is conducted to be in contact with the pick-up fabric 22 in the area between two wire leading rolls 20*a* and 20*b*. The suction box 45 placed against the pick-up roll 21 increases the dry matter content of the web W efficiently before its transfer to the press section. The suction zone 21*a* of the pick-up roll 21 is arranged to follow the curved sector of the suction box 45, whereby it secures that the web W will follow the pick-up fabric 22 after the ending of the suction provided by the suction box 45. In a conventional web transfer supported by the lower wire, a suction box as the one introduced, arranged to be in connection with the pick-up roll, causes difficulties in transferring the web into the couch pit in a break situation. When the web W is brought to the pick-up point while being adhered to the underside of the upper wire 11, guiding the web into the couch pit is feasible even as late as at the guide roll 20*a* preceding the pick-up roll 21. In FIG. 6, arrow B shows the point from which the web W can be easily lead down, for instance by directing air blow thereat through the wire 11. Dropping the web down may, in fact, be carried out also using release members known themselves in the art and positioned below the web.

The invention is described above, reference being made only to some advantageous embodiments thereof, to the details of which the invention is not, however, intended to be strictly restricted. A number of modifications and variations are conceivable within the scope of the inventive idea defined by the claims below.

What is claimed is:

1. An arrangement in the wet end of a paper machine for transferring a web from a former to a press section, said former comprising a twin wire zone defined mutually by an upper wire loop and a lower wire loop, whereafter the web is arranged to follow the upper wire to a transfer point in which the web is transferred from the underside of the upper wire onto the top side of a fabric included in the press section, wherein at the end of the twin wire zone there is provided a suction box inside the upper wire loop, and facing the suction box an open roll inside the lower wire loop, the suction box having a lid which is curved at least in a run situation so that the tension of the upper wire reduces the normal force between the wire and the lid caused by the underpressure of the suction box, and within which suction box underpressure can be arranged which keeps the web at the suction box mainly off from the roll and from the lower wire while being adhered onto the underside of the upper wire and conforming to the curved shape of the lid of the suction box, the upper wire having a run extending downstream from the suction box with the web supported on the underside thereof, and that members comprising a blowing box, a suction box, or a suction part of the open roll are arranged in connection with the suction box and/or the roll for making the web follow the lower wire in a break situation for conducting it to a broke handling system.

2. The arrangement of claim 1, wherein the members comprise a suction/blow unit arranged on a straight course of the upper wire after the suction box, wherein underpressure is optionally adjusted for supporting the web to the upper wire or overpressure for making the web follow the lower wire in a break situation for conducting it to the broke handling system.

3. The arrangement of claim 1, wherein the members comprise a suction zone arranged inside the roll, wherein underpressure can be adjusted for guiding the web to follow the lower wire in a break situation for conducting it to the broke handling system.

4. The arrangement of claim 1, wherein the proportion of the open surface area of the roll body is dimensioned so that the web automatically follows the lower wire in a situation in which no underpressure is arranged in the suction box.

5. The arrangement of claim 1, wherein under the web, trimming members are provided in the travelling direction thereof after the suction box for trimming the web and for separating the trimmed strips formed during the trimming and conducting them to the broke handling system.

6. The arrangement of claim 5, wherein after the trimming members, an air blow is arranged in the area of both edges of the web to be directed at the web through the upper wire, which blow is arranged to separate the trimmed strip off from the web.

7. The arrangement of claim 5, wherein after the trimming members, a smooth roll is arranged in the area of both edges of the web, being in width equal to the trimmed strip, to the surface of which the trimmed strip is arranged to adhere for separating it from the web.

8. The arrangement of claim 1 wherein after the suction box, the web is arranged to follow the upper wire to the transfer point, in which it is transferred with the aid of a pick-up roll from the underside of the upper wire onto the top side of the press section fabric.

9. The arrangement of claim 1, wherein after the suction box, the web is arranged to follow the upper wire to a pre-press nip in which it is transferred from the underside of the upper wire onto the top side of a transfer belt.

10. The arrangement of claim 1, wherein after the suction box, the web is arranged to follow the upper wire to a transfer point which is preceded by a wire leading roll placed in a position from which the web can be dropped down before the transfer point in a break situation.

11. An apparatus for transferring a web from a former to a press section in the wet end of a paper machine, comprising:

a former having a twin wire zone defined between an upper wire loop and a lower wire loop;

a press section after the former, the press section having a first fabric having a top side;

a suction box positioned at the end of the twin wire zone inside the upper wire loop;

an open roll inside the lower wire loop and facing the suction box, wherein the suction box has a lid which is curved at least in a run situation so that the tension of the upper wire reduces the normal force between the upper wire and the lid caused by the underpressure of the suction box, and within which suction box underpressure can be arranged which keeps the web at the suction box mainly off from the roll and from the lower wire while being adhered onto the underside of the upper wire and conforming to the curved shape of the lid of the suction box;

wherein the web is arranged to follow the upper wire after the suction box to a transfer point in which the web is transferred from the underside of the upper wire onto the top side of the first press fabric in the press section; and a suction/blow unit arranged on a straight course of the upper wire after the suction box, wherein underpressure is optionally adjusted for supporting the web to the upper wire or overpressure for making the web follow the lower wire in a break situation for conducting it to a broke handling system.

12. The apparatus of claim 11, further comprising a suction zone arranged inside the roll, wherein underpressure can be adjusted for guiding the web to follow the lower wire in a break situation for conducting it to the broke handling system.

13. The apparatus of claim 11, wherein the proportion of the open surface area of the roll body is dimensioned so that the web automatically follows the lower wire in a situation in which no underpressure is arranged in the suction box.

14. The apparatus of claim 11 further comprising trimming members positioned under the web downstream of the suction box for trimming the web and for separating trimmed strips formed during the trimming and conducting them to the broke handling system.

15. The arrangement of claim 14 further comprising an air blow positioned after the trimming members in the area of two edges of the web, the air blow being directed at the web through the upper wire, which blow is arranged to separate the trimmed strips off from the web.

16. The arrangement of claim 15 further comprising a smooth roll positioned after the trimming members, the smooth roll being in width equal to the trimmed strip, to the surface of which the trimmed strip is arranged to adhere for separating it from the web.

17. The apparatus of claim 11 further comprising a pre-press nip positioned after the suction box, and wherein the web is arranged to follow the upper wire to the pre-press nip in which it is transferred from the underside of the upper wire onto the top side of a transfer belt.

18. The apparatus of claim 11 further comprising a wire leading roll after the suction box, the upper wire extending to the wire leading roll, and the web is arranged to follow the upper wire to a transfer point which is preceded by the wire leading roll placed in a position from which the web can be dropped down before the transfer point in a break situation.

19. An apparatus for transferring a web from a former to a press section in the wet end of a paper machine, comprising:

a former having a twin wire zone defined between an upper wire loop and a lower wire loop;

a press section after the former, the press section having a first fabric having a top side;

a suction box positioned at the end of the twin wire zone inside the upper wire loop;

an open roll inside the lower wire loop and facing the suction box, wherein the suction box has a lid which is curved at least in a run situation so that the tension of the upper wire reduces the normal force between the upper wire and the lid caused by the underpressure of the suction box, and within which suction box underpressure can be arranged which keeps the web at the suction box mainly off from the roll and from the lower wire while being adhered onto the underside of the upper wire and conforming to the curved shape of the lid of the suction box;

wherein the web is arranged to follow the upper wire after the suction box to a transfer point in which the web is transferred from the underside of the upper wire onto the top side of the first press fabric in the press section; and a suction zone arranged inside the open roll, wherein underpressure can be adjusted for guiding the web to follow the lower wire in a break situation for conducting it to a broke handling system.

20. The apparatus of claim 19, wherein the proportion of the open surface area of the roll body is dimensioned so that the web automatically follows the lower wire in a situation in which no underpressure is arranged in the suction box.

21. The apparatus of claim 19 further comprising trimming members positioned under the web downstream of the suction box for trimming the web and for separating trimmed strips formed during the trimming and conducting them to the broke handling system.

22. The arrangement of claim 21 further comprising an air blow positioned after the trimming members in the area of two edges of the web, the air blow being directed at the web through the upper wire, which blow is arranged to separate the trimmed strips off from the web.

23. The arrangement of claim 21 further comprising a smooth roll positioned after the trimming members, the smooth roll being in width equal to the trimmed strip, to the surface of which the trimmed strip is arranged to adhere for separating it from the web.

24. The apparatus of claim 21 further comprising a pre-press nip positioned after the suction box, and wherein the web is arranged to follow the upper wire to the pre-press nip in which it is transferred from the underside of the upper wire onto the top side of a transfer belt.

25. The apparatus of claim 19 further comprising a wire leading roll after the suction box, the upper wire extending to the wire leading roll, and the web is arranged to follow the upper wire to a transfer point which is preceded by the wire leading roll placed in a position from which the web can be dropped down before the transfer point in a break situation.

* * * * *